United States Patent [19]

Edelman

[11] Patent Number: 5,035,517

[45] Date of Patent: Jul. 30, 1991

[54] RECLOSABLE SHIPPING SACK

[75] Inventor: Paul F. Edelman, Greenwood, Ind.

[73] Assignee: KCL Corporation, Shelbyville, Ind.

[21] Appl. No.: 635,404

[22] Filed: Dec. 31, 1990

Related U.S. Application Data

[63] Continuation of Ser. No. 325,247, Mar. 17, 1989, abandoned.

[51] Int. Cl.[5] ..... B65D 33/26; B65D 33/24

[52] U.S. Cl. ..... 383/61; 383/63; 383/79; 383/81

[58] Field of Search ..... 383/5, 61, 63, 65, 79, 383/81

[56] References Cited

U.S. PATENT DOCUMENTS

| | | | |
|---|---|---|---|
| 2,978,164 | 4/1961 | Williams et al. | 383/81 |
| 3,181,583 | 5/1965 | Lingenfelter | 383/81 |
| 3,228,585 | 1/1966 | Fleming | 383/61 |
| 4,241,865 | 12/1980 | Ferrell . | |
| 4,252,238 | 2/1981 | Spiegelberg et al. | 383/63 |
| 4,337,889 | 7/1982 | Moertel | 383/61 |
| 4,589,145 | 5/1986 | Van Erden et al. | 383/65 |
| 4,620,320 | 10/1986 | Sullivan | 383/61 |
| 4,637,063 | 1/1987 | Sullivan et al. | 383/61 |
| 4,691,370 | 9/1987 | MacFee | 383/61 |
| 4,782,951 | 11/1988 | Griesbach et al. . | |
| 4,824,261 | 4/1989 | Provost | 383/81 |
| 4,848,928 | 7/1989 | Ausnit | 383/63 |

*Primary Examiner*—Stephen P. Garbe

*Attorney, Agent, or Firm*—Woodard, Emhardt, Naughton, Moriarty & McNett

[57] ABSTRACT

A reclosable sack having a mouth from which contents may be discharged, including a primary non-reclosable stitched fastener across and closing the mouth. The stitched fastener includes a removable chain stitch and tear strip for facilitating manual opening of the primary fastener. The reclosable sack also includes a secondary reclosable fastener having a pair of interlocking profile strips that are attached at lower inner wall portions to the upper edge of the sack walls outboard of the stitched fastener. The secondary profile fastener is heat sealed at its ends and allows the sack to be reclosed once the primary non-reclosable fastener has been removed.

6 Claims, 2 Drawing Sheets

RECLOSABLE SHIPPING SACK

This application is a continuation of application Ser. No. 325,247, filed Mar. 17, 1989 now abandoned.

BACKGROUND OF THE INVENTION

This invention relates to the field of tamper-resistant reclosable bags or sacks, and is more particularly concerned with reclosable sacks having a primary non-reclosable fastener and a secondary reclosable fastener.

Various schemes have been proposed for tamper-resistant bags which are equipped with reclosable fasteners and also with some means to preclude access to the contents of the bag without leaving evidence of tampering. Many of these schemes are for packaging relatively small quantities of goods so that plastic tear webs or weakened web areas are adequate to withstand normal wear of handling, packing and shipping.

However, such tamper-resistant closures are not satisfactory for heavier, bulkier goods, such as dog food, charcoal, cat litter and the like, which ordinarily require packaging which will withstand in excess of fifteen pounds contents weight. For this type of goods, the bags have typically only had a primary non-reclosable fastener of some sort. One drawback of this approach to closures for sacks carrying bulky goods is that the sacks are not reclosable, so that the opened packages are susceptible to spillage when upset. In addition, the contents are often liable to attract vermin or to dry out as a result of remaining open. It is desirable that efficient, inexpensive, reclosable means be provided for such sacks for bulky goods because the contents may necessarily have to be poured from the sack by increments with often substantial intervals between demands for more of the sack's contents.

The device of the patent to Ferrell, U.S. Pat. No. 4,241,865, assigned to the assignee of the present application, is an attempt to overcome many of the disadvantages of these prior art non-reclosable packages or sacks. This patent describes a reclosable sack with a primary non-reclosable stitched fastener and a secondary reclosable fastener of a zipper type located outboard of the primary closure fastener. While the invention of the Ferrell patent provides a tamper-resistant reclosable sack for carrying heavy, bulky goods, it also has a drawback in that it is generally complicated to produce. The production of sacks having the primary non-reclosable and secondary zipper fasteners requires several spools of material to be joined in a continuous process. The zipper requires end stops for the travel of the zipper. Further, the zipper requires that the end stops be properly oriented on the bag. In other words, the zipper needs to be properly registered on the bag.

SUMMARY OF THE INVENTION

The invention provides a reclosable sack having a pouring mouth from which discrete, pourable contents may be discharged. The reclosable sack comprises a primary non-reclosable stitched separable fastener across and closing the mouth of the sack. A secondary, reclosable fastener is also provided across the mouth outboard of the primary closure fastener. The secondary reclosable fastener includes a pair of opposing profile elements that can be alternatively joined or interlocked, by manually pressing the profiles together or separated by pulling apart flanges on the elements.

It is an aim of the present invention to overcome the disadvantages and drawbacks of the prior art approaches to packaging bulky and heavy materials in reclosable tamper-proof sacks or packages. One important object is to provide an improved reclosable sack that is easier and more efficient to produce.

Another object of the present invention is to provide an improved reclosable sack that does not require separate closure pieces, such as a zipper slider or zipper stops. Other objects, features and advantages of the invention will be readily apparent from the following description and accompanying figures.

In the method of producing the reclosable sack of the invention, the opposing profile elements are separately formed, interlocked and wound onto a reel. In a continuous process, the secondary fastener is payed off the reel and lower mounting portions of the profile elements affixed to the walls of a succession of sacks. The ends of the profile elements are heat sealed between adjacent sacks. A separate reel is provided with a cord or thread wound thereon. The cord is sewn into a chain stitch along and closing the mouth of the sack. The stitching is sewn to permit manually unraveling the chain stitch. The closed sacks are separated by severing the secondary fastener at the heat sealed portion.

DESCRIPTION OF THE PREFERRED EMBODIMENT

Figure 1:
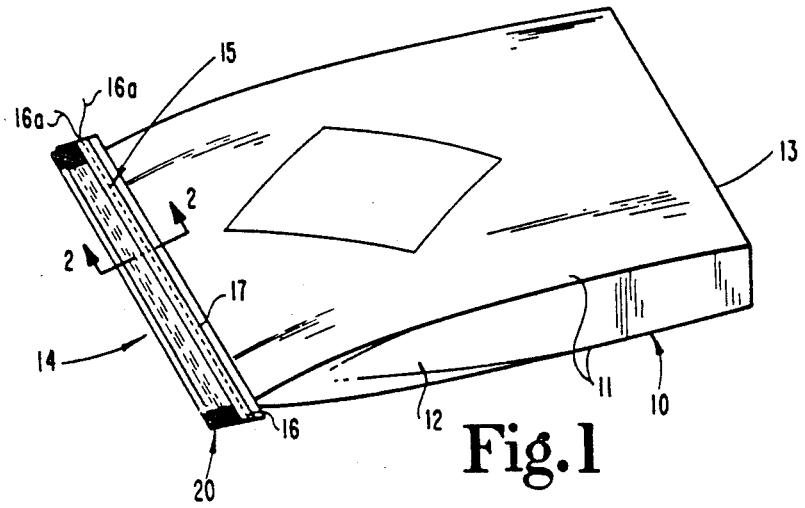
FIG. 1 is a perspective view of a reclosable sack embodying the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A reclosable sack 10 comprises a body which may be made from any suitable material and which may be one ply or multi-ply, depending upon the material used and the contents of the sack. In the preferred embodiment, the sack 10 is shown as having front and back face walls 11 and opposite side walls 12, all composed of two ply heavy paper. Alternatively, the sack walls 11 and 12 may be composed of a plastic material such as polyethylene or polyvinylchloride. In the preferred embodiment, the sack 10 includes a fixed bottom closure 13 that may be a permanent lock stitching or, in the case of a plastic material, a heat sealed or adhesive seam.

Figure 2:
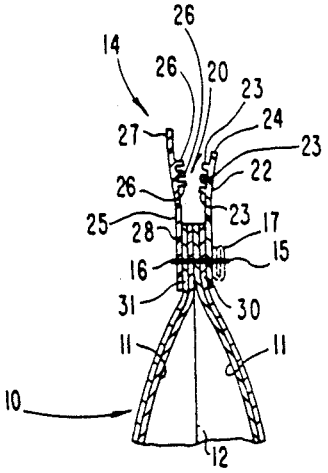
FIG. 2 is an enlarged fragmentary cross-sectional view taken along line 2—2 of FIG. 1 as viewed in the direction of the arrows.

The reclosable sack includes a top closure 14, shown in more detail in the cross-sectional view of FIG. 2. According to the present invention, the top closure 14 includes a non-reclosable separable stitched fastener 15 and a secondary reclosable fastener 20, so that the sack is a tamper-resistant container when initially filled and sealed but reclosable when opened by the consumer. When it is desired to gain access to the contents of the sack, the primary non-reclosable stitched fastener is adapted to be opened to provide access to the mouth of the sack, while the secondary reclosable fastener is adapted to be reclosable over the mouth of the sack once the primary fastener has been removed.

The primary non-reclosable fastener 15 includes a thread, string or cord 16 sewn into a line of chain stitches that secure the sack walls 11 tightly together. The cord 16 is sewn into a chain stitch so that with free ends 16A exposed. The chain stitch may be pulled apart or unraveled by manually pulling the free ends 16A. In order to facilitate removal of the chain stitch 16 of the primary closure, a tear strip or rip tape 17, shown in dash lines in FIG. 2, is provided. The rip tape 17 is stitched together with the sack walls 11 when the primary non-reclosable fastener is manufactured.

Figure 4:
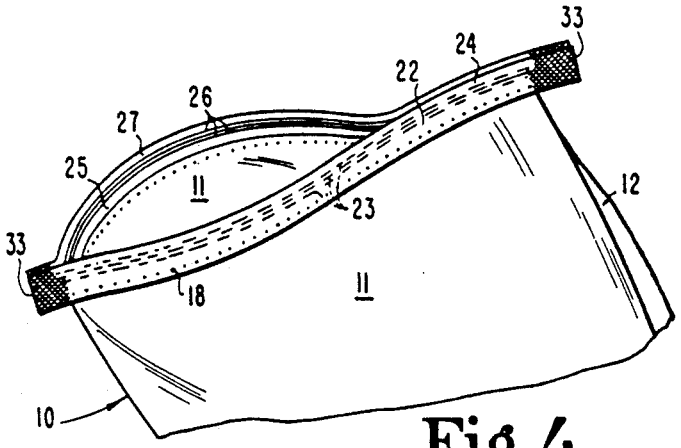
FIG. 4 is a fragmentary perspective view with the primary and secondary fasteners opened for pouring access to the sack contents.

The secondary reclosable fastener includes a pair of opposing profile elements or strips 22 and 25. The first profile strip 22 includes a number of ribs 23 projecting from its inner surface. Profile strip 25 includes a number of ribs 26 projecting from its inner surface and oriented for interlocking engagement with the ribs 23 of the opposing profile strip 22. The interlocking rib profiles 23 and 26 extend sufficiently above the top edge or opening of the sack to allow the ribs 23 and 26 to be interlocked in the manner shown in FIG. 7. As is conventional in the art, the profile strips 22 and 25 can be interlocked to close the top of the sack by manually applying pressure along the outer surfaces of the profile strips to press the ribs into engagement. The interlocking ribs 23 and 26 can be disengaged by grasping flanges 24 and 27 extending above the interlocking ribs. When the flanges 24 and 27 are separated or pulled apart, the interlocking ribs 23 and 26 are disengaged. The profile strips 22 and 25 are adhesively mounted to the upper edge of the sack walls 11 at mounting portions 30 and 31 of the strips 22 and 25, respectively. The chain stitched cord 16 of the primary non-reclosable fastener 15 is sewn through the mounting portions 30 and 31 of the profile strips. The profile strips 22 and 25 are sealed together at their ends 33, as shown in FIG. 4. Preferably, the strips are heat sealed at the ends 33, although sonic welding, adhesive or similar sealing methods may be used. The purpose of the seal is to close the ends of the profile strips to insure an air-tight seal when the bag is reclosed and to keep the interlocking ribs in proper registry. Heat sealing the ends 33 of the profile strips of the reclosable sack of the present invention overcomes a disadvantage of the prior art zipper fasteners in which the zipper cannot completely close the sack mouth. Moreover, the prior art zipper fasteners are susceptible to opening inadvertently, whereas the profile strips 22 and 25 of the present invention assure a positive seal that is highly resistant to accidental opening.

Figure 3:
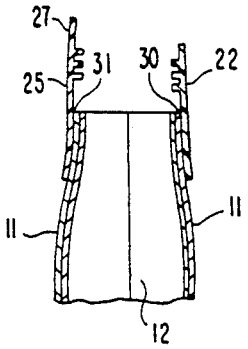
FIG. 3 is a view similar to FIG. 2 in which the primary non-reclosable closure is opened.

FIGS. 3 and 4 show the reclosable sack of the present invention with the primary non-reclosable fastener 15 removed. Once the chain stitched cord 16 has been pulled loose to unravel the chain stitching, a number of small punctures 18 are visible along the side walls 11 and through the profile strips 22 and 25 where the stitching was previously located. With the non-reclosable fastener 15 removed, the top of the sack is open to permit access to the contents within. The top of the sack can be reclosed using the two profile strips 22 and 25 and their corresponding interlocking ribs 23 and 26.

Figure 5:
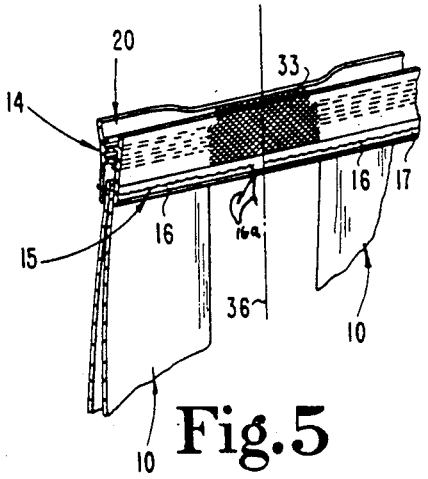
FIG. 5 is a fragmentary perspective view showing how a succession of sacks is adapted to be equipped with closures and then separated one from the other.
Figure 6:
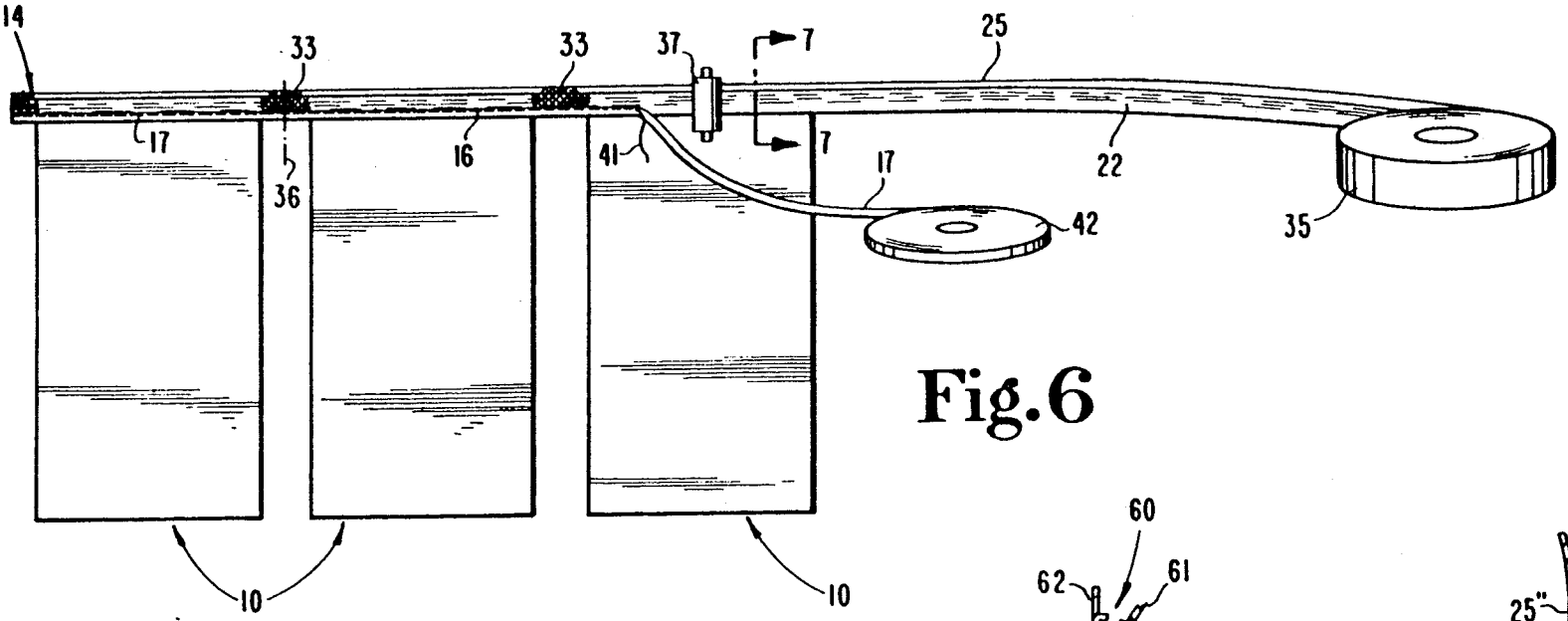
FIG. 6 is a schematic illustration of the steps taken in making the reclosable sacks of the present invention.
Figure 7:
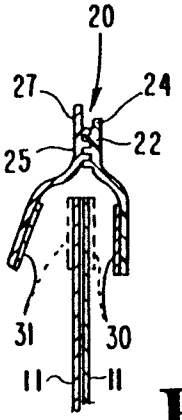
FIG. 7 is a fragmentary cross-sectional view taken along line 7—7 of FIG. 6 as viewed in the direction of the arrows.

The method of producing the reclosable sack of the present invention is illustrated with reference to FIGS. 5–7. The reclosable sack can be manufactured in a continuous process in which a number of such sacks are provided with the top closure 14. The number of sacks 10 are filled in a prior operation with the mouth of the sack left open.

In a separate operation, the second reclosable fastener 20, including the profile strips 22 and 25, are formed in a conventional extrusion process. The profile strips are joined and wound onto a supply reel 35. The interlocked fastener 20 is payed off the reel 35 and arranged over the mouth of sacks 10 as shown in FIGS. 6 and 7. The lower mounting portions 30 and 31, respectively, of the interlocking profile strips 22 and 25 are affixed to the sack walls 11 by an adhesive applied at the inner surfaces of the strips. Alternatively, the adhesive may be applied directly to the sack walls 11, rather than the inner surfaces of the profile strips. The adhesive applied at mounting portions 30 and 31 must be of a type sufficient to bond plastic to the sack material, whether the sack is made from a plastic or a paper material. The lower ends of the plastic profile strips 22 and 25 can be pressed against the sack walls 11 by a pair of rollers 37 situated at opposite sides of the sack. However, other suitable means may be provided for insuring a strong bond between the sack walls 11 and the reclosable interlocked reclosable fastener 20.

Once the reclosable fastener 14 has been adhered to the walls 11 of the sack 10, the ends of the reclosable profiles are heat sealed at locations 33. In the continuous manufacture of the sack of the present invention, the heat sealing operation occurs between adjacent sacks 10.

The primary non-reclosable fastener 15 may be applied either before or after the heat sealing operation. In the preferred embodiment, the primary fastener is applied prior to heat sealing because the cord 16 and the tear strip 17 are composed of a non-plastic material that is not susceptible to heat sealing. If the tear strip 17 is composed of a plastic material, the application of the tear strip must occur after heat sealing to leave the strip free for removal.

In applying the primary stitched fastener 15, a cord or string 41 is payed off of a reel or spool (not shown) and sewn in a conventional manner in a chain stitch that is tight enough to seal the sack opening but loose enough to be unraveled. During the chain stitching operation period it is important that free ends 16A be left for the cord 16 to allow the chain stitch to be pulled apart when it is desired to open the sack. If a tear strip 17 is included, a spool 42 is provided from which the tear strip is payed prior to the chain stitch sewing operation. Once the primary non-reclosable fastener has been applied, the individual sacks 10 are cut apart between the bags along a cut line 36 passing through the center of the heat sealed portion 33 of the reclosable profile fastener 14.

Figure 8:
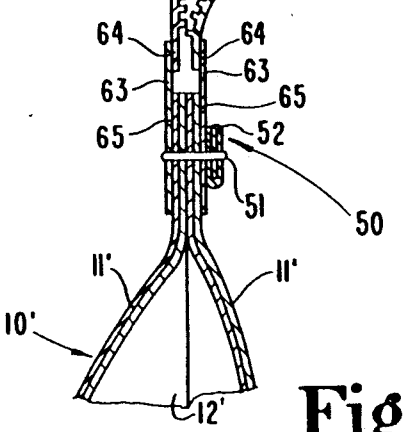
FIG. 8 is an enlarged fragmentary cross-sectional view similar to the view of FIG. 2 showing a second embodiment of the present invention.

Referring to FIG. 8, a second embodiment of the reclosable sack of the present invention is illustrated. A reclosable sack 10' includes outer walls 11' and 12' and a primary non-reclosable fastener 50 including a chain stitch string or cord 51 with a pull or tear strip 52. The secondary reclosable fastener 60 includes a pair of profile strips 61 and 62 that are adhered to a second pair of strips 63. The strips 63 in this embodiment are composed of the same material as the tear strip 52, such as, for example, crepe paper. The profile strips 61 and 62, which are plastic, are adhered at their outer surfaces to the inner surfaces of the strips 63 at locations 64. The second pair of strips 63 themselves are adhered at their inner surfaces to the sack walls 11' at locations 65. A benefit of this embodiment is that the like materials of the sack walls 11' and the strips 63 are easy and fast to adhere in a continuous manufacture of sacks, as opposed to the dissimilar materials being adhered in the embodiment of FIG. 7. The profile strips 61 and 62 may be separately applied to the strips 63 prior to the sack manufacture and wound upon a supply reel, such as reel 35 illustrated in FIG. 6.

Figure 10:
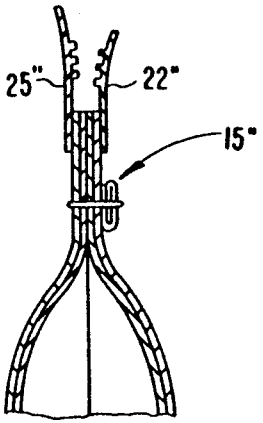
FIG. 10 is a view similar to FIG. 9 of the completed further embodiment of FIG. 9 after manufacture is complete.
Figure 9:
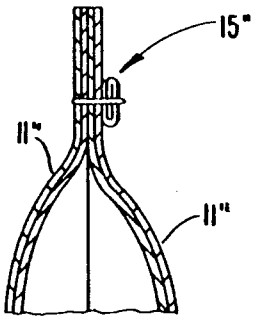
FIG. 9 is a view similar to FIG. 2 of a further embodiment of the invention showing it after an intermediate step of manufacture.

FIGS. 9 and 10 illustrate a further embodiment of the method and sack of this invention. The embodiment illustrated in FIGS. 9 and 10 is identical to the embodiment of FIG. 2 with the exception that the stitching is completed on the sack before the plastic reclosable closure is placed on the sack. Thus, FIG. 9 shows the stitched fastener 15'' attached through the sack walls 11'' without the profile strips 22'' and 25'' being present. In a later step as shown in FIG. 10, the plastic profile strips 22'' and 25'' are secured to the sack outboard of the stitched fastener 15''.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A reclosable sack having a mouth through which the contents of the sack may be removed, comprising:

primary non-reclosable closure means across the mouth of the sack for closing the mouth, including a stitched separable fastener adapted for manual removal to open said primary closure means; and secondary reclosable closure means secured to the sack across the mouth of the sack outboard of said primary closure means, for closing the mouth after opening of said primary closure means, including oppositely disposed first and second cooperating profile elements selectively interlockable when pressed together and releasable when separated.

2. The reclosable sack of claim 1 wherein:

said primary closure means includes a tear strip for facilitating removal of said stitched fastener.

3. The reclosable sack of claim 2 wherein:

each of said first and second profile elements is composed of a heat-sealable material and each includes opposite ends extending beyond the sides of the sack;

said first and second profile elements are heat sealed together at said opposite ends;

said tear strip is substantially contguous with said first profile element between said opposite ends of said first profile element; and said tear strip is composed of a non-heat-sealable material.

4. The reclosable sack of claim 1 wherein:

each of said first and second profile elements includes a lower mounting portion affixed to a wall of the sack; and said stitched fastener includes a chain stitch passing through the walls of the sack and through said lower mounting portion of each of said first and second profile elements, said chain stitch including a free end for unraveling said chain stitch when said free end is pulled.

5. The reclosable sack of claim 1 wherein:

each of said first and second profile elements includes opposite ends extending beyond the sides of the sack; and said first and second profile elements are sealed together at said opposite ends.

6. The reclosable sack of claim 1 wherein:

each of said first and second profile elements includes an exposed upper flange adapted to be manually grasped and pulled apart to separate said first and second profile elements.

* * * * *